United States Patent [19]

Downing

[11] 3,993,241

[45] Nov. 23, 1976

[54] COLLAPSIBLE CONTAINER

[75] Inventor: Benjamin A. Downing, Peoria, Ill.

[73] Assignee: Caterpillar Tractor Co., Peoria, Ill.

[22] Filed: Mar. 1, 1976

[21] Appl. No.: 662,651

[52] U.S. Cl. ..... 229/33; 229/17 B
[51] Int. Cl.[2] ..... B65D 5/72
[58] Field of Search ..... 229/17 B, 33

[56] References Cited

UNITED STATES PATENTS

| | | | |
|---|---|---|---|
| 2,568,725 | 9/1951 | Fey | 229/17 B |
| 2,676,746 | 5/1954 | Kellog et al. | 229/17 B |
| 3,536,247 | 10/1970 | Gadiel | 229/17 B |
| 3,568,911 | 3/1971 | Bebout | 229/17 B |
| 3,944,128 | 3/1976 | Hogan | 229/17 B |

*Primary Examiner*—Davis T. Moorhead
*Attorney, Agent, or Firm*—Eugene C. Goodale

[57] ABSTRACT

A collapsible container is disclosed in which the container is cut from a single blank. The blank may be folded so as to form an angled front panel together with an open front area for entrance into and out of the container. Cooperative locking means formed in the blank permit relative locking and holding of the respective panels when the container is in the opened or assembled condition. The end opposite the open front area is suitably closed.

10 Claims, 8 Drawing Figures

COLLAPSIBLE CONTAINER

BACKGROUND OF THE INVENTION

This invention relates generally to containers, and more particularly to a collapsible container formed from a single unitary blank.

There are a multitude of collapsible type containers and the like available in the art. Examples of such collapsible containers are found in the following U.S. Pat. Nos.: Taub 3,872,965; Hall 3,881,648; McGlynn 3,883,067; Silver 3,883,068; Ross 3,884,348; and Wilson 3,887,126. These containers may be used to store and transport a multitude of items. However, each of these containers generally has four sides and an open top. This construction prevents the stacking of a multitude of such containers one on top of the other without a special frame and also prevents easy retrieval of the contained items.

Accordingly, it is an object of the present invention to provide a collapsible container which is formed from a single unitary blank and when in the open condition presents a partially open front area.

A further object of this invention is to provide a collapsible container which may be stacked one on top of the other, yet will permit easy access into the interior of the container while in the stacked condition.

SUMMARY

A collapsible container is formed from a single blank such that an open front area exists in the assembled condition. A front panel is held in place so as to form a partial barrier to prevent items from falling out of the container.

Other objects, details, uses, and advantages of this invention will become apparent as the following description of the exemplary embodiments thereof presented in the accompanying drawings proceeds.

BRIEF DESCRIPTION OF THE DRAWINGS

The accompanying drawings show present exemplary embodiments of this invention in which.

DESCRIPTION OF ILLUSTRATED EMBODIMENTS

Figure 1:
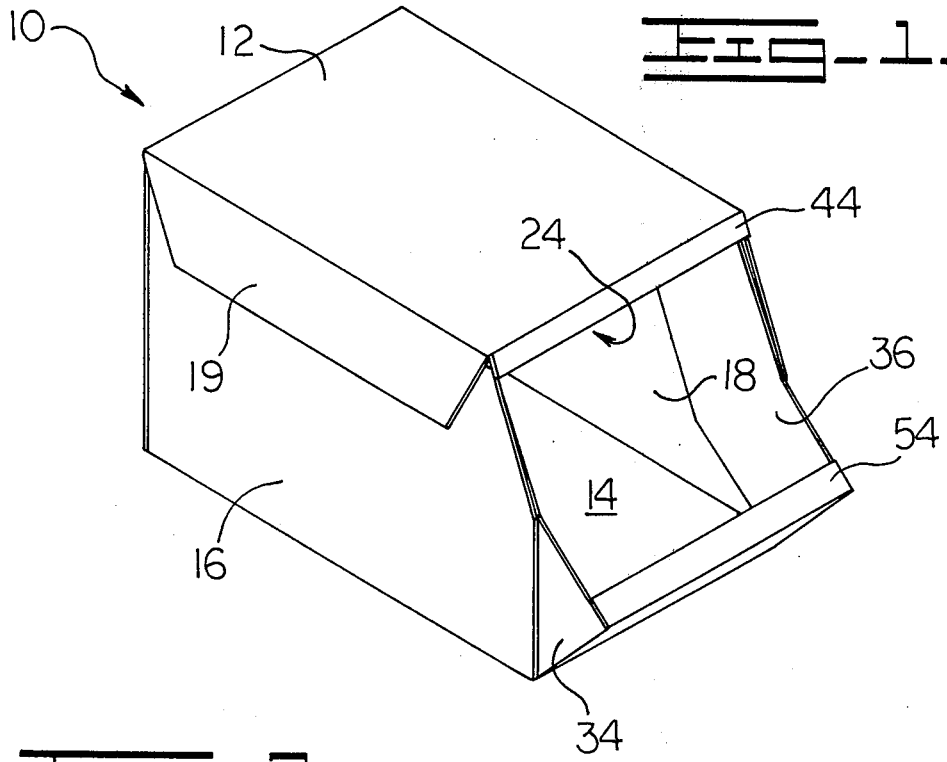
FIG. 1 is a perspective view of the container in the assembled condition.
Figure 2:
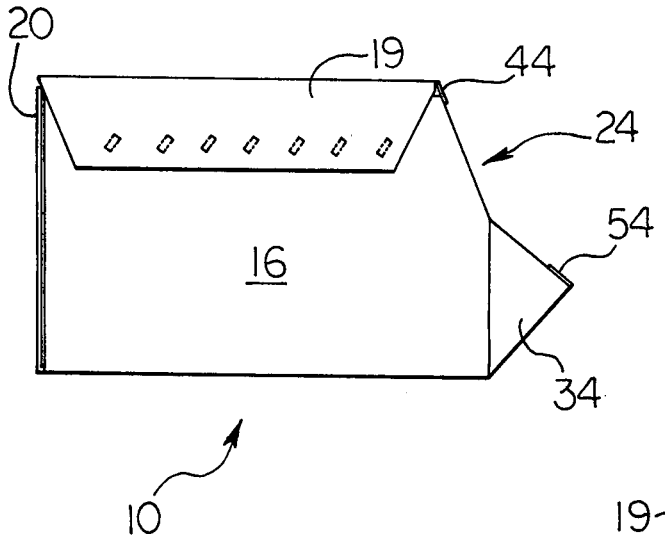
FIG. 2 is a side view of the container of FIG. 1.
Figure 3:
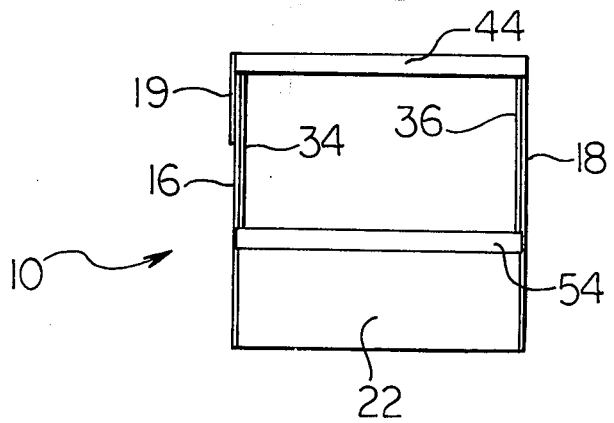
FIG. 3 is a front view of the container.

Reference is now made to FIGS. 1–3 of the drawings, which illustrate one exemplary embodiment of the improved collapsible container of this invention, which is generally designated by the reference numeral 10. The container is comprised generally of a top 12, bottom 14, sides 16 and 18, end panel 20, and a front panel 22. In the assembled or opened condition, the container 10 defines generally a box-like configuration with an open area 24 at one end thereof. A flap 19, hingedly attached at 21 to the top 12, is secured by any suitable means to the side 16. Any suitable means may be used to secure the flap 19 to the side 16 such as stitching, glue, staples, etc.

Figure 4:
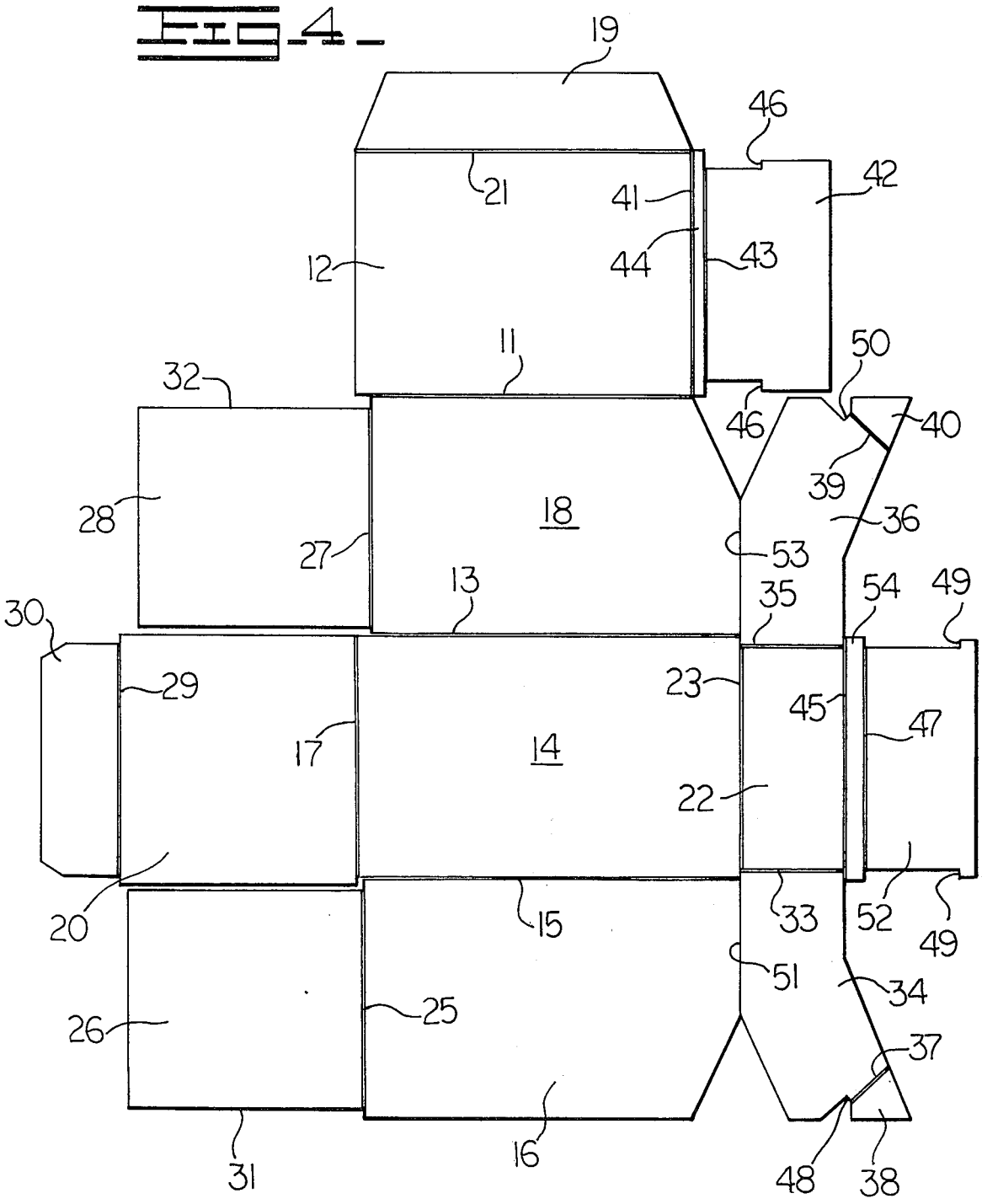
FIG. 4 is an inside view of the blank used to form the container of FIG. 1.

It is seen in FIG. 4 that the container 10 is formed from a single unitary blank which is precut and scored so as to form the appropriate parts and hinges for the container. Accordingly, hinge lines 11, 13, 15, 17, and 23 form the respective hinge connections between the top 12, side 18, bottom 14, side 16, end panel 20, and front panel 22.

Figure 5:
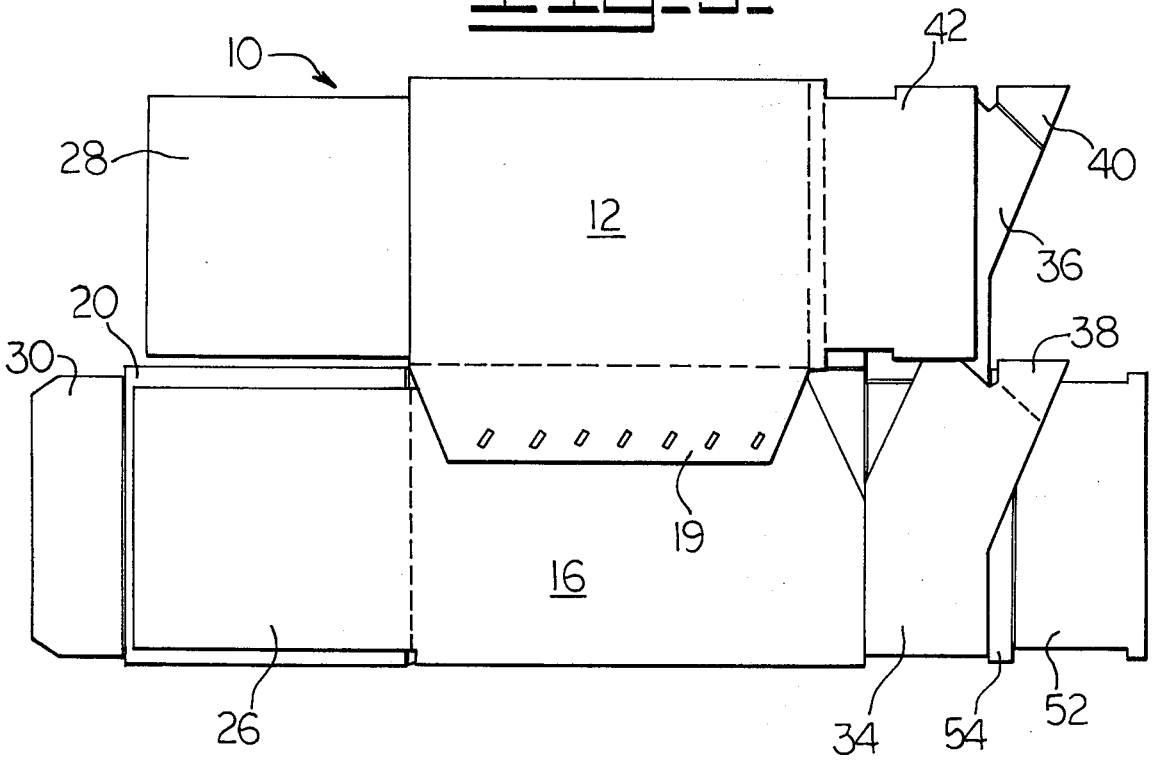
FIG. 5 is a side view showing the container in the collapsed condition.
Figure 7:
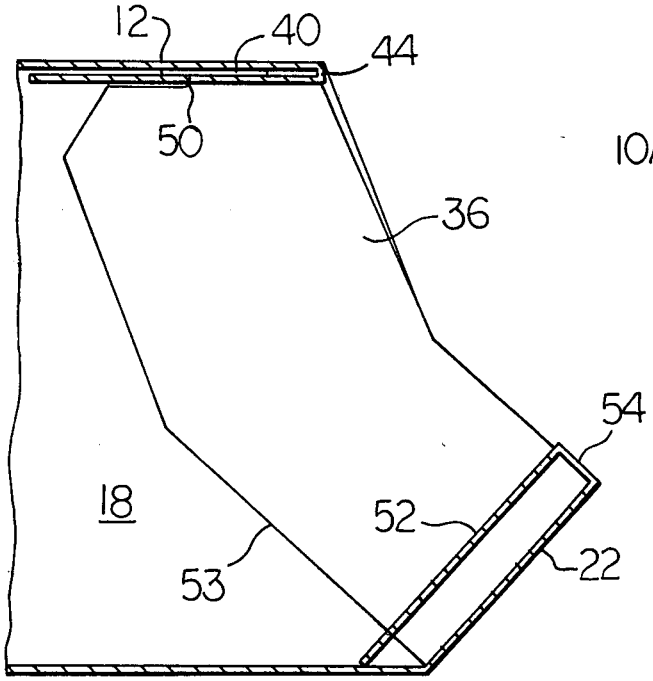
FIG. 7 is a partial side section of the front and top panel in the open condition.
Figure 6:
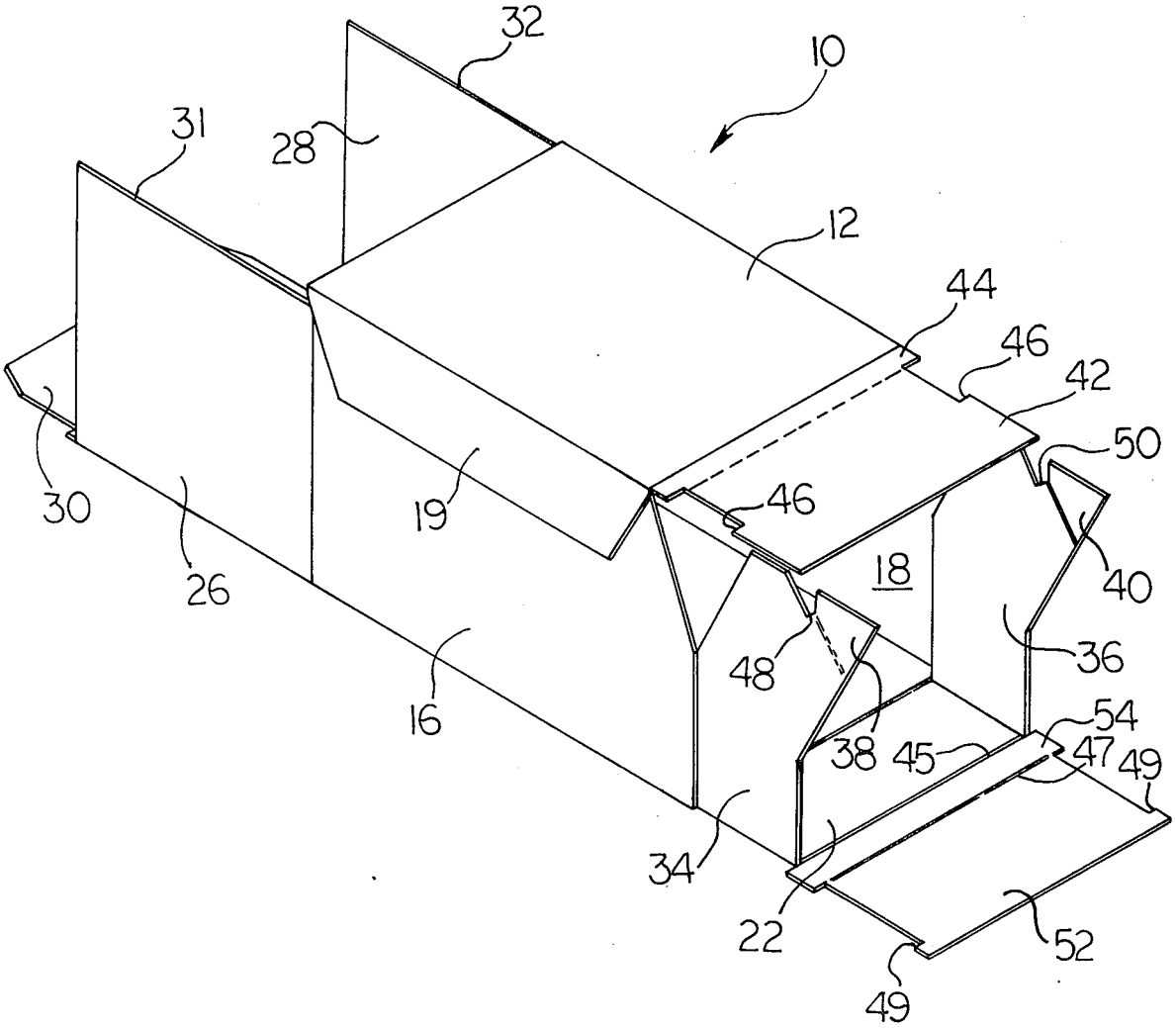
FIG. 6 is a perspective view of the container of FIG. 1 with the front and rear panels partially folded.

The folding and assembly of the container 10 is best seen in FIGS. 5–7. Once the flap 19 has been secured to the side 16, the container 10 may be collapsed and stored in a substantially flat condition as seen in FIG. 5.

The container 10 is assembled by first opening the blank into the condition shown in FIG. 6. End flaps 26 and 28 are then folded inwardly about hinge lines 25 and 27 (FIG. 4) to close the open end of the container 10. The end panel 20 is folded upwardly about hinge line 17 so as to cover the respective end flaps 26 and 28. Closure panel 30 is folded about hinge line 29 and inserted between the top panel 12 and edges 31 and 32 of the end flaps 26 and 28. One end of the container 10 is thus completely closed. The closed end thereof may not be forced open by any parts or material held within the container 10. In order to open the closed end thereof, the closure panel 30 must first be retracted from between the top panel 12 and edges 31 and 32 of the respective end flaps.

To assemble the front portion of the container 10, the front flaps 34 and 36 are pivoted about hinge lines 33 and 35 to the position shown in FIG. 6. The front flap corners 38 and 40 are pivoted inwardly about hinge lines 37 and 39. The flaps 34 and 35 are pivoted into the interior of the container 10. This causes the front panel 22 to be pivoted in the upward direction about hinge line 23 to the position shown in FIG. 7.

As seen in FIG. 7, the front flap corners 38 (not shown) and 40 are substantially parallel to the top panel 12. The top locking panel 42 is then folded down and into the interior of the container 12 about hinge lines 41 and 43 so as to form or define a top lip 44. The flap corners 38 and 40 are thus positioned between the top 12 and top locking panel 42. The top locking panel 42 is formed with a pair of tab shoulders 46. The shoulders 46 cooperatively engage corner shoulders 48 and 50 to securedly hold or lock the respective front flaps 34 and 36 in the position shown in FIGS. 1 and 7.

The front locking panel 52 is then pivoted into the interior of the container 10 about hinge lines 45 and 47 so as to define a front panel lip 54. The front locking panel 52 is formed with a pair of locking tabs having shoulders 49 which cooperatively engage the front flap edges 51 and 53 as best seen in FIG. 7. The cooperative engagement of shoulders 49 and edges 51 and 53 secures the flap 52 as seen in FIG. 7. Flap 52 provides for added strength for the front panel and prevents damage to panel 22 from objects placed in the container 10.

The leading edge of the front flaps 34 and 36 is complementally shaped with the leading edge of the sides 16 and 18. Accordingly, when the container 10 is in the assembled condition (FIGS. 1, 2, and 7), the respective leading edges of the front flaps 34 and 36 coincide with the leading front edges of the sides 16 and 18. As best seen in FIGS. 2 and 7, the front panel 22 is supported in an angular position by the flaps 34 and 36. The angular positioning of the front panel 22 helps to define a substantially large open area 24 (FIGS. 1 and 2). The substantially large open area 24 permits easy entrance into and out of the container 10. The container 10 may be constructed from any suitable material such as cardboard or fiberboard. In instances where it is desirable to provide an atmosphere resistant, i.e., water and moisture resistant, as well as a fire retardant material yet having high strength qualities, fiberboard manufactured by the Laminite Division of Tri-Wall Containers, Inc., Plainview, New York has been used with good success.

Figure 8:
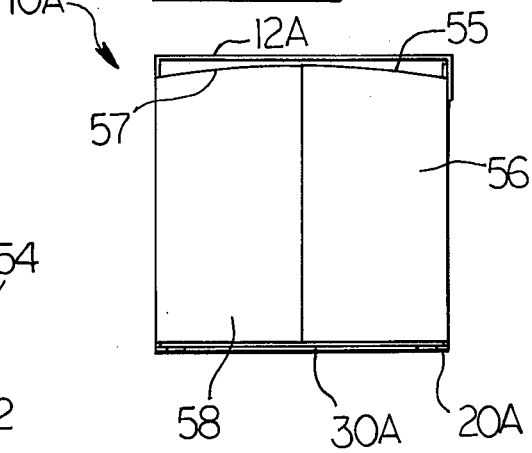
FIG. 8 is a rear view of an alternate rear configuration for the container of FIG. 1.

Another exemplary embodiment of this invention is illustrated in FIG. 8 of the drawings. The collapsible container illustrated in FIG. 8 is very similar to the collapsible container 10; therefore, such container will be designated generally by the reference numeral 10A, and parts of the container 10A which are very similar to corresponding parts of the collapsible container 10 will be designated by the same reference numeral as collapsible container 10 also followed by the letter designation A and not described again. The main difference between the container 10A and the container 10 is in the formation of the end flaps 56 and 58. When the flaps 56 and 58 are pivoted inwardly about their respective hinge lines, the outer edges of the respective flaps substantially meet at the center of the container 10A. The upper edges 55 and 57 of the respective flaps 56 and 58 are of a curvilinear shape. The high point of each respective edge is substantially near the center of the container 10A when the flaps are in the closed position. Hence, when the closure panel 30A of the end panel 20A is inserted between the respective edges 55–57 and the top 12A, a frictional engagement is still maintained. Hence, the closed end panel 20A may not be forced outwardly from the interior of the container 10A without first removing the closure panel 30A.

It may be seen that a collapsible container has been described which has great utility. Although the present invention has been shown and described as a generally rectangularly shaped container of certain parameters, it is obvious that the size of the container may be varied by appropriate changes in the dimensions of the various panels and flaps. The partially open front area permits ready entrance into and out of the container. The containers may be stacked one upon the other while still permitting access into the container. The respective flaps cooperate with one another to be locked and held in place so as to provide a sturdy and reusable container.

While present exemplary embodiments of this invention have been illustrated and described, it will be recognized that this invention may be otherwise variously embodied and practiced by those skilled in the art.

What is claimed is:

1. A collapsible container formed of a single cut and scored blank, the container comprising:

a pair of sides;

a top and bottom, said sides being hingedly connected to opposite edges of said bottom, and said top being hingedly connected to one edge of one of said sides, said top, bottom, and sides defining an open ended generally rectangular shape in the assembled and opened condition;

means to permit securing of said top to the other one of said sides;

means to close one end of the container;

a front panel hingedly connected to the bottom at the open end thereof, said front panel having a pair of front flaps respectively hingedly connected to opposite side edges of said front panel, each of said front flaps foldably overlying the inner face of the respective sides; and a locking panel hingedly connected to said top and overlying the inner face of said top in an inwardly folded condition, said top locking panel being folded inwardly to cooperatively engage each of said front flaps, thereby securing said flaps and front panel in the open position and defining a partially open area at the front of the container.

2. The container according to claim 1 in which said securing means includes a flap hingedly connected to said top, said securing flap being fixably attachable to said other one of said sides.

3. The container according to claim 1 in which each of said front flaps include a corner hingedly connected thereto, said corner being foldable to be positioned between said top locking panel and the inner face of said top wherein outward pivoting movement of said front panel and front flaps is prevented.

4. The container according to claim 3 in which each of said front flaps includes a shoulder formed therein, said top locking panel being formed with complementally formed shoulders wherein said top locking panel shoulders cooperatively engage each of said front flap shoulders whereby inward pivoting movement of said front panel and front flaps is prevented and said front flap is held in an angularly disposed position.

5. The container according to claim 4 in which said securing means includes a flap hingedly connected to said top, said securing flap being fixably attachable to said other one of said sides.

6. The container according to claim 4 further comprising a front locking panel hingedly connected with said front panel, said front locking panel being foldable inwardly to cooperatively engage an edge of each front flap so as to be lockably maintained therein and thereby providing added front panel support.

7. The container according to claim 4 in which said closing means includes an end flap hingedly connected to one end of said side, said flap being foldable to a closed position so as to close said one end of the container.

8. The container according to claim 4 in which said closing means includes an end flap hingedly connected to one end of each of said sides, said flaps being foldable inwardly to close said one end of the container.

9. The container according to claim 8 further comprising an end panel hingedly connected to the bottom at the closing end thereof and overlying said end flaps; a closure panel hingedly connected to said end panel and foldable to be frictionally inserted between the edge of said end flaps and the inner face of said top.

10. The container according to claim 9 in which said end flaps are formed with a height greater near the middle of the container and a lesser height near said side.

* * * * *